US010211520B2

(12) United States Patent
Szini et al.

(10) Patent No.: US 10,211,520 B2
(45) Date of Patent: Feb. 19, 2019

(54) ELECTRONIC DEVICE WITH TRANSPARENT ANTENNA

(71) Applicant: Motorola Mobility LLC, Chicago, IL (US)

(72) Inventors: Istvan Janos Szini, Grayslake, IL (US); Eric Le Roy Krenz, Crystal Lake, IL (US)

(73) Assignee: MOTOROLA MOBILITY LLC, Chicago, IL (US)

( * ) Notice: Subject to any disclaimer, the term of this patent is extended or adjusted under 35 U.S.C. 154(b) by 64 days.

(21) Appl. No.: 15/290,669

(22) Filed: Oct. 11, 2016

(65) Prior Publication Data

US 2018/0102588 A1 Apr. 12, 2018

(51) Int. Cl.
*H01Q 1/27* (2006.01)
*H01Q 1/24* (2006.01)
(Continued)

(52) U.S. Cl.
CPC ..... *H01Q 1/273* (2013.01); *H01Q 1/2291* (2013.01); *H01Q 1/24* (2013.01); *H01Q 1/241* (2013.01);
(Continued)

(58) Field of Classification Search
CPC ..... H01Q 1/273; H01Q 1/24; H01Q 1/241; H01Q 1/38; H01Q 1/2291; H01Q 13/106
See application file for complete search history.

(56) References Cited

U.S. PATENT DOCUMENTS 5,781,155 A 7/1998 Woo et al.
9,954,268 B2 4/2018 Zou et al.
(Continued)

FOREIGN PATENT DOCUMENTS

CN 105094231 A 11/2015
EP 1280224 A 1/2003
EP 1603188 A1 12/2015

OTHER PUBLICATIONS

Hong, S. et al. (2015). "A Flexible and Transparent Antenna on a Polyimide Substrate for Laptop Computers." IEEE International Symposium on Antennas and Propagation and North American Radio Science Meeting, Jul. 19-24, 2015, 930-931, Vancouver, BC, Canada.

(Continued)

*Primary Examiner* — Hoang V Nguyen

(57) ABSTRACT

Embodiments include an electronic device comprising a display unit operable to electronically display information; an antenna formed from at least one transparent conductor extending across a top surface of the display unit; and wireless communication circuitry operatively coupled to the antenna and positioned below the display unit. According to certain aspects, the at least one transparent conductor, the display unit, and the wireless communication circuitry may be stacked in parallel to each other and a housing for encasing the wireless communication circuitry and at least a portion of the display unit. One embodiment includes an electronic watch comprising a watch face operable to electronically display information; an antenna formed from at least one transparent conductor extending across a top surface of the watch face; and a watch housing for housing at least a portion of the watch face and wireless communication circuitry operatively coupled to the antenna.

19 Claims, 3 Drawing Sheets

(51) Int. Cl.

| | |
|---|---|
| ***H01Q 1/22*** | (2006.01) |
| ***H01Q 13/10*** | (2006.01) |
| *H01Q 7/00* | (2006.01) |
| *H01Q 9/30* | (2006.01) |
| *H01Q 9/42* | (2006.01) |

(52) U.S. Cl.
CPC ..... *H01Q 13/106* (2013.01); *H01Q 7/00* (2013.01); *H01Q 9/30* (2013.01); *H01Q 9/42* (2013.01)

(56) References Cited

U.S. PATENT DOCUMENTS

2013/0059532 A1* 3/2013 Mahanfar ..... H04B 5/0031 455/41.1
2014/0104157 A1 4/2014 Burns et al.
2014/0106684 A1* 4/2014 Burns ..... H01Q 1/243 455/78
2014/0139379 A1* 5/2014 Bolin ..... H01Q 1/243 343/702
2014/0240176 A1 8/2014 Tolbert et al.
2015/0325905 A1* 11/2015 Randjelovic ..... H01R 13/2414 343/718
2016/0190678 A1* 6/2016 Hong ..... H01Q 1/38 343/700 MS

OTHER PUBLICATIONS

Kirsch, N. et al. (2010) "Performance of Transparent Conductive Polymer Antennas in a MIMO Ad-hoc Network." 2010 IEEE 6th International Conference on Wireless and Mobile Computing, Networking and Communications, Oct. 11-13, 2010, 9-14, Niagra Falls, Canada.
Heraeus Clevios GmbH (2010). "CLEVIOS™ PH 1000", Dec. 12, 2010, 1-2, Leverkusen, Germany.
Hong, S. et al. (2015). "Transparent and Flexible Antenna for Wearable Glasses Application" IEEE, 1-7.
Combined Search and Examination Report dated Mar. 28, 2018 for GB1716501.0, 8 pages.

* cited by examiner

ELECTRONIC DEVICE WITH TRANSPARENT ANTENNA

This application generally relates to electronic devices, and more specifically to electronics devices with transparent antennas on or within a display glass of the device.

BACKGROUND

Connected wearable devices, or "connected wearables," can include, for example, electronic watches or "smartwatches," activity trackers or "smart wristbands," electronic glasses or "smartglasses," and other electronic devices that can be worn on a user's body and support one or more wireless technologies, such as, for example, 2G, 3G, 4G, 5G, Wi-Fi, Bluetooth, and GPS (Global Positioning System). Connected wearables may enable the user to enjoy active lifestyles, in-person interactions, and/or live social settings without keeping a full-sized, full-featured smartphone at hand, but still stay connected to certain network-based features. For example, many connected wearables may be paired with a smartphone in order to receive notifications therefrom (e.g., via Bluetooth) and share other functionalities therewith, essentially serving as a front end for the phone. As another example, some connected wearables, including certain smartwatches, have autonomous GPS capabilities, independent of a smartphone, and can display maps and offer navigation services.

There is an increasing demand for connected wearables that can offer experiences native to the device itself and/or can operate without keeping a smartphone nearby. This level of independent functionality requires connection to a cellular network or other wireless wide area network (WWAN), in addition to Wi-Fi or other wireless local area network (WLAN), Bluetooth or other wireless personal area network (WPAN), and/or GPS. However, due to their wearable and portable nature, wearable devices tend to be small in size, which physically limits the radio-frequency performance capabilities of such devices. Good antenna performance becomes even more difficult to achieve when trying to pack all of the antennas required for 2G, 3G, 4G, WWAN, WLAN, WPAN, and GPS connectivity into a wearable form factor. Accordingly, there is an opportunity for a connected wearable with good antenna performance across various wireless networks, include WWAN.

SUMMARY

One example embodiment includes an electronic device comprising a display unit operable to electronically display information; an antenna formed from at least one transparent conductor extending across a top surface of the display unit; and wireless communication circuitry operatively coupled to the antenna and positioned below the display unit. The at least one transparent conductor may be a coating placed on top of the top surface of the display unit or embedded into the top surface of the display unit. In some cases, the at least one transparent conductor may extend across at least a substantial portion of the top surface of the display unit. An outer edge of the at least one transparent conductor may be visually transparent relative to the display unit. The electronic device may also include a housing for encasing the wireless communication circuitry and at least a portion of the display unit. In such cases, the antenna may have a slot antenna structure formed between the at least one transparent conductor and at least a portion of the housing. In some cases, the at least one transparent conductor, the display unit, and the wireless communication circuitry may be stacked in parallel to each other and the housing. The antenna may enable communication over a plurality of frequency bands. In addition, the antenna may enable communication with at least one cellular communication network and/or at least one non-cellular wireless communication network. In some cases, the antenna may include a plurality of transparent conductors arranged across the top surface of the display unit, each of the plurality of transparent conductors forming a separate antenna structure.

Another example embodiment includes an electronic watch comprising a watch face operable to electronically display information; an antenna formed from at least one transparent conductor extending across a top surface of the watch face; and a watch housing for housing at least a portion of the watch face and wireless communication circuitry operatively coupled to the antenna. The at least one transparent conductor may be a coating applied to the top surface of the watch face. In some cases, the at least one transparent conductor may extend across at least a substantial portion of the watch face. The antenna may have a slot antenna structure formed between the at least one transparent conductor and at least a portion of the watch housing some cases, the at least one transparent conductor, the watch face, and the wireless communication circuitry may be stacked in parallel to each other and the watch housing. The antenna may transmit signals to and receives signals from at least one cellular network. In some cases, the antenna may enable communication with at least one non-cellular wireless communication network. The electronic watch may also include a wristband coupled to the watch housing. In some cases, the wristband may include a conductive material and may be electromagnetically isolated from the transparent conductor of the antenna.

BRIEF DESCRIPTION OF THE DRAWINGS

The accompanying figures, where, like reference numerals refer to identical or functionally similar elements throughout the separate views, together with the detailed description below, are incorporated in and form part of the specification, and serve to further illustrate embodiments of concepts that include the claimed embodiments, and explain various principles and advantages of those embodiments.

DETAILED DESCRIPTION

Figure 1:
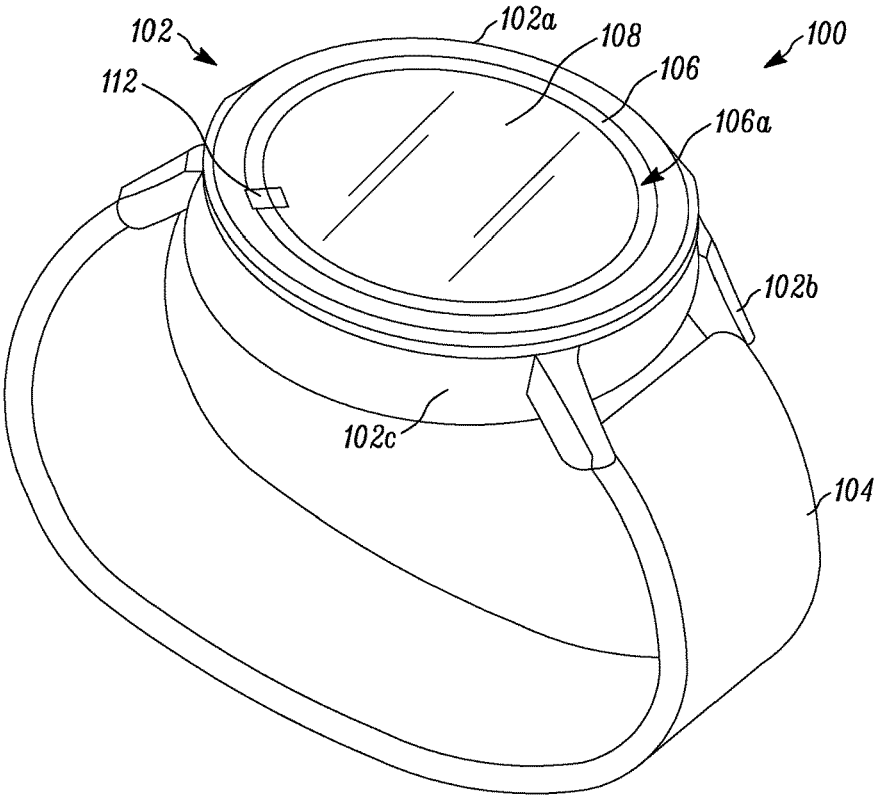
FIG. 1 illustrates a first example electronic device in accordance with certain embodiments.

Most existing smartwatches have a small form factor that provides very little space for additional antennas and circuitry to support, both cellular and non-cellular communications. For example, smartwatches typically include a watch housing and wristband for housing the antennas, wireless communication circuitry, and all other electronics. However, the dimensions of such watch housing and wristband and the proximity with biologic tissue can physically limit the antenna performance (e.g., efficiency and bandwidth) of the smartwatch, as compared to larger electronic devices, such as mobile phones. For example, the watch housing may have a diameter of about 45 millimeters (mm) and a thickness of about 10 mm, while the free-space wavelength for certain frequencies of interest may be 120 to 430 millimeters (mm). Also, due to the dimensions of a typical watch housing, there is a physics-based limitation to the number of independent antennas that can be packaged into the smartwatch within the bands of interest. For example, due its electrically-small form factor, the typical smartwatch cannot include a MIMO or diversity antenna for supporting higher data throughputs, in addition to a main antenna for cellular and other WWAN communications, a GPS antenna, a Bluetooth antenna, and a Wi-Fi antenna. Without the MIMO antenna, the smartwatch may spend more time on the network in order to download a given data payload, which can consume battery power and slow down connection speeds. In addition, because smartwatches are worn in close proximity to the user's body, the antenna efficiency of such devices may be further compromised by impedance loading and other absorption losses effects resulting from human tissue.

Embodiments described herein expand the antenna "real estate" of a wearable electronic device, such as a smartwatch, by using transparent conductors to create one or more antennas on top of a display lens (e.g., the watch face) of the electronic device. That is, rather than burying the antennas within a housing of the device (e.g., the watch housing), the embodiments described herein bring the antennas to the top surface of the electronic device and are able to use most, if not all, of the display lens to form the antenna structure(s). Moreover, placing the antenna on top of the display portion of a smartwatch or other wearable can create sufficient space between the antenna and the user's body to minimize antenna efficiency losses due to human body detuning, as well as allow replacement of the conductive or non-conductive wristband without loss of antenna radiation performance due to coupling. Thus, the embodiments described herein can enhance the overall radiated performance of small form factor wearables and provide the capability to support multiple antennas, or a single multi-band antenna, for providing both main and MIMO diversity functions, as well as various non-cellular functions, such as, e.g., GPS, and Bluetooth, as described in more detail below.

FIG. 1 illustrates an exemplary electronic device 100 consistent with some embodiments. While the electronic device 100 is shown as an electronic watch or "smartwatch," it should be appreciated that the depicted device 100 is merely an example and that the electronic device 100 can include any type of electronic device having a display screen and capable of communicating via an antenna. For example, the electronic device 100 may include another type of wearable device (such as, e.g., a health monitor, an activity tracker, an electronic wristband, electronic glasses, etc.), any type of mobile or portable electronic device (such as, e.g., a smartphone, tablet, laptop, personal digital assistant (PDA), MP3 player, gaming device, etc.), or any non-portable or static electronic device comprising a display and communication circuitry.

As shown in FIG. 1, the electronic device 100 includes a housing 102 (also referred to herein as a "watch housing") coupled to a band 104 (also referred to as a "watchband" or "wristband") for attaching the electronic device 100 to a user's wrist. The band 104 can be mechanically coupled to the housing 102 to permit interchangeability with other watchbands. The housing 102 can house or encase most, if not all, of the various circuitry, electronics, and other devices required for operation of the electronic device 100, including a display unit 106 (also referred to herein as a "display" or "watch face"). The display unit 106 (or "display") can be operable to electronically display information and/or images during operation of the electronic device 100. As an example, the display unit 106 may comprise a lens made of Gorilla® glass or other suitable material.

In the illustrated embodiment, the housing 102 includes a display bezel 102*a* for securing the display 106 to the housing 102, a frame 102*b* for coupling the watchband 104 to the housing 102, and a base 102*c* for sealing a bottom surface of the housing 102, the frame 102*b* being coupled between the display bezel 102*a* and the base 102*c*. The housing 102 may be made of any suitable material, such as, for example, plastic and/or metal. As will be appreciated, in other embodiments, the housing 102 of the electronic device 100 may include additional or fewer components than those shown and described herein.

Figure 2:
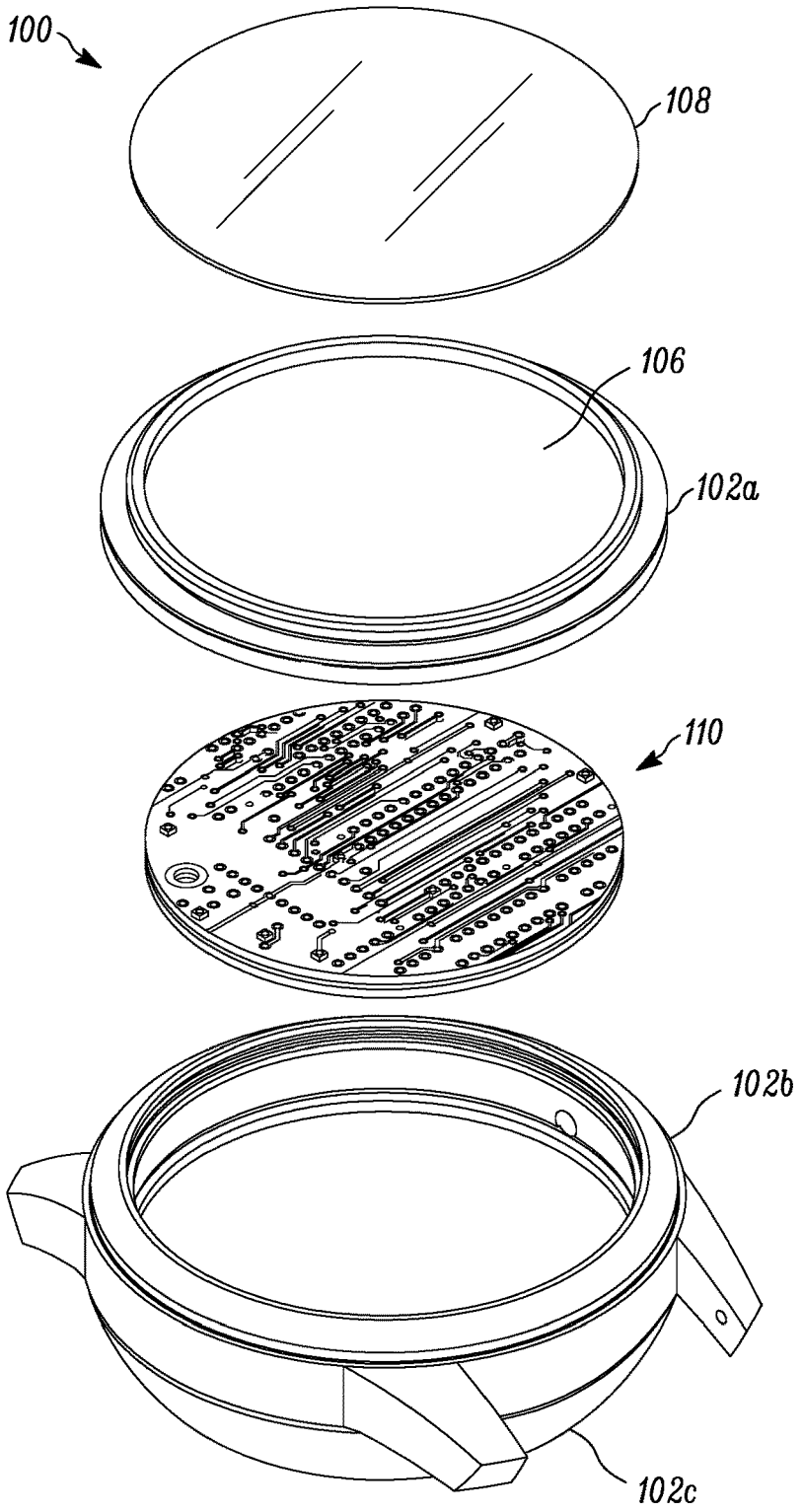
FIG. 2 illustrates a partially exploded view of the electronic device of FIG. 1, in accordance with certain embodiments.

Referring additionally to FIG. 2, shown is a partially exploded view of the electronic device 100 of 1 in accordance with certain embodiments. More specifically, FIG. 2 depicts an exploded view of an upper portion of the housing 102, namely the portions housed between or adjacent to the display bezel 102*a* and the outer frame 102*b*. Though not shown, additional electronics or circuitry may be included within the base 102*c*, or between the outer frame 102*b* and the base 102*c*.

Referring to FIGS. 1 and 2, the electronic device 100 further includes an antenna 108 configured to transmit and receive wireless signals for facilitating certain operations of the electronic device 100. As shown, the antenna 108 extends across a top surface 106*a* of the display 106. In order to retain the display function of the display unit 106, the antenna 108 (also referred to herein as a "transparent antenna") can be formed from a transparent conductor, such as, for example, but not limited to, a transparent conductive polymer (e.g., Clevios™ PEDOT/PSS PH500, PH1000, LOCTITE ECI 1011, etc.) or any other highly conductive material that is visually transparent relative to the display 106. For example, any images or information displayed on the display 106 may be substantially, if not equally, visible through the transparent antenna 108. As shown in FIG. 2, the antenna 108 may be deposited or placed on top of the display 106, for example, as a coating that is directly applied to the top surface 106*a*. In other cases, the antenna 108 can be embedded into the top surface 106*a* of the display 106, so that the antenna 108 is still positioned at or towards the top of the display 106.

The transparency exhibited by the antenna 108 can depend on a thickness of the transparent conductor. For example, the transparency of the antenna 108 may increase as the thickness of the transparent conductor is reduced, or diluted. However, the thickness of the transparent conductor can also affect the conductivity of the antenna 108. For example, the conductivity of the antenna 108 may be directly proportional to the thickness of the transparent conductor. Thus, there can be a tradeoff between providing high transparency and high conductivity in the antenna 108. In one example embodiment, the thickness of the transparent conductor is 80 microns (μm) with a resulting conductivity of $5\times10^5$ S/m and a transparency level of 92 percent in the visible wavelength.

The antenna 108 can be configured as any suitable type of antenna. In some embodiments, the antenna 108 may be configured as a slot antenna formed by exciting the space between the transparent conductor coated on the display 106 and a metal portion of the housing 102. For example, the outer frame 102*b* may be made of stainless steel or other metal and may serve as an antenna ground plane to facilitate the antenna functions of the transparent conductor. In other embodiments, other antenna topologies may be utilized to form the antenna 108, such as, for example, monopole, loop, planar inverted-F antenna (FIFA), inverted-F antenna (IFA), inverted-L antenna (ILA), dual-band inverted-L antenna (DILA), etc.

In some embodiments, the shape and/or type of the antenna 108 may be selected in order to provide uniform transparency across the top surface 106*a* of the display, or otherwise minimize obstructions and provide a clearer field of view when viewing the display 106. For example, generally speaking, the imagery displayed on a display may appear distorted near the edges of a transparent antenna placed thereon due to refraction and other optical effects present at the boundaries between the display and the transparent conductor. As a result, an outline may be visible at the boundary between the display and the transparent conductor. Uniform transparency across the display 106 may be achieved by minimizing the number of edges created by the antenna 108 and/or minimizing the gap between an outer edge of the antenna 108 and an outer edge of the display 108. In the illustrated embodiment, the antenna 108 consists of a single, continuous structure extending across a substantial portion of the top surface 106. Further, as shown in FIG. 1, the antenna 108 has a generally circular shape that substantially matches the generally circular shape of the display 106. As a result, the outer edge of the antenna 108 extends close to the outer edge of the display 106, and no other edges are present in the antenna 108. Due to this configuration, the outer edge of the antenna 108 may be virtually transparent relative to the display 106. In other embodiments, the antenna 108 may be shaped and sized to cover the entire top surface 106*a* of the display 106, so that an outer edge of the antenna 108 is aligned with an outer edge of the display 106 (for example, as shown by electronic device 400 in FIG. 4). In such cases, the outer edge of the antenna 108 may be completely transparent relative to the display 106.

Figure 3:
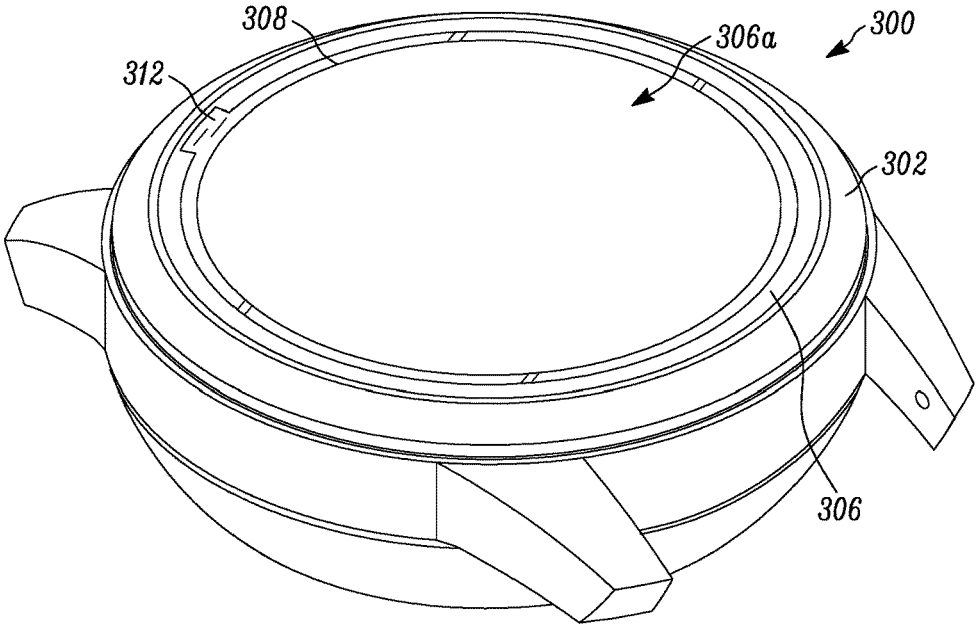
FIG. 3 illustrates a second example electronic device in accordance with certain embodiments.

FIG. 3 illustrates another example electronic device 300 having an alternative antenna shape, in accordance with certain embodiments. As shown, the electronic device 300 may include a housing 302 that is substantially similar to the housing 102 shown in FIG. 1 and a display 306 that is substantially similar to the display 106 shown in FIG. 1. In addition, the electronic device 300 includes an antenna 308 formed from a transparent conductor having a ring-like structure, as shown in FIG. 3. In embodiments, the antenna 308 may be a slot antenna formed from the ring-like transparent conductor and at least a portion of the housing 302. As shown in FIG. 3, the antenna 308 can be positioned on a top surface 306*a* of the display 306 around a periphery of the display 306. An outer diameter of the transparent conductor may be selected so that the antenna 308 is positioned adjacent to an outer edge of the display 306, so as to minimize optical obstructions when viewing the display 306. A thickness of the antenna 308 (e.g., a distance between the inner and outer diameters of the transparent conductor) may be selected based on a desired radio-frequency performance, such as, for example, to support coverage of select operating bands. The antenna 308 may be coupled to an antenna feed 312 that is operatively coupled to wireless communication circuitry (not shown) included in the housing 302, similar to the antenna feed 112 shown in FIG. 1.

Referring back to FIGS. 1 and 2, in some embodiments, the antenna 108 includes a single antenna structure formed from the transparent conductor. In such cases, the antenna 108 may be, for example, a multi-band antenna configured to operate across a plurality of frequency bands (also referred to as "operating bands") to support a plurality of wireless technologies. In other embodiments, the antenna 108 may comprise a plurality of antenna structures arranged adjacent to each other across the top surface 106 of the display 102, each antenna structure being formed from a separate piece or portion of the transparent conductor material. In such cases, each antenna structure may be configured to operate in a different frequency band.

In embodiments, the antenna 108 can be electrically coupled to one or more circuitry components 110 included in the housing 102 below the display unit 106 via an antenna feed 112 coupled to the antenna 108. In some embodiments, the antenna feed 112 can be a capacitive feed for forming a contactless connection between the antenna 108 and the circuitry 110. In other embodiments, the antenna feed 112 can be any other type of feed suitable for use with the antenna 108. The one or more circuitry components 110 can include, for example, a processor (such as, e.g., processor 502 shown in FIG. 5), a memory (such as, e.g., memory 504 shown in FIG. 5), and/or wireless communication circuitry (such as, e.g., wireless communication circuitry 506 shown in FIG. 5) for facilitating radio-frequency-based operations of the electronic device 100. As an example, the wireless communication circuitry may include at least one transmitter, receiver, or transceiver configured for operation according to each wireless communication technology supporting by the antenna 108. In embodiments, the antenna 108 and the wireless communication circuitry can be configured to support communication with a plurality of wireless networks, including at least one cellular communication network (e.g., LTE or other WWAN) and at least one non-cellular communication network (e.g., WiFi or other WLAN, Bluetooth or other WPAN, and GPS).

Figure 4:
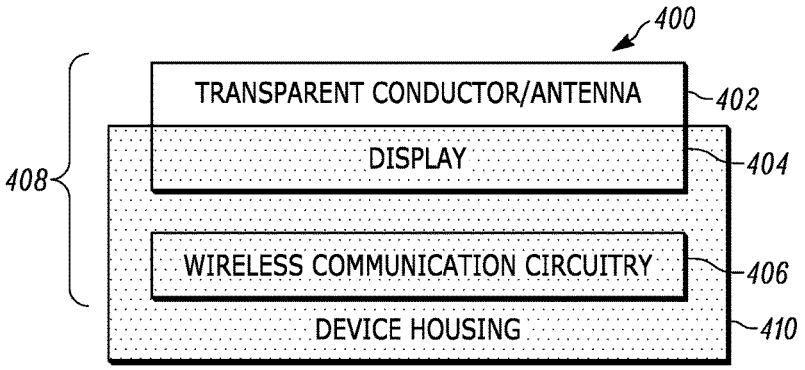
FIG. 4 is a block diagram of a cross-sectional view of an example electronic device in accordance with certain embodiments.

FIG. 4 illustrates a cross-sectional view of an exemplary electronic device 400 in accordance with embodiments. The electronic device 400 may be similar to, or implemented as, the electronic device 100 shown in FIGS. 1 and 2. As illustrated in FIG. 4, the electronic device 400 includes an antenna 402 that is formed from at least one transparent conductor (such as, e.g., the transparent antenna 108 shown in FIG. 1) and is positioned above a display device 404 (such as, e.g., the display 106 shown in FIG. 1) of the electronic device 400. The display device 404 is positioned above wireless communication circuitry 406 (such as, e.g., wireless communication circuitry 506 shown in FIG. 5) included in the electronic device 400.

In embodiments, the antenna 402, the display 404, and the circuitry 406 may be stacked in parallel to each other to form a stacked configuration, or component stack 408 shown in FIG. 4. In addition, the component stack 408 can be at least partially positioned in a housing 410 of the electronic device 400 (such as, e.g., housing 102 shown in FIG. 1). As shown in FIG. 4, the component, stack 408 can be positioned in parallel to the housing 410, thus extending the stacked configuration of the electronic device 400 to include the housing 410. In some cases, the antenna 402 may be positioned adjacent to and just outside the housing 410, while the remaining components (e.g., the display device 404 and the circuitry 406) are positioned inside the housing 410, as shown in FIG. 4. In other cases, the antenna 402 may be embedded into a top surface (or lens) of the display device 404, and the entire component stack 408 (i.e. including the antenna 402) may be positioned within the housing 410.

The overall stacked configuration of the electronic device 400 may help maximize a utility of each component included in the component stack 408 and/or an overall utility of the device 400. For example, by stacking or layering the antenna 402, the device 404, and the wireless communication circuitry 406 on top of each other, a surface area of each component of the stack 408 can be maximized without interfering with the operation of the other layers. As shown in FIG. 4, this feature of the component stack 408 may be implemented by configuring each component of the stack 408 to have substantially similar dimensions, such that the edges of the components are substantially aligned. In one embodiment, for example, each of the antenna 402, the display 404, and the wireless communication circuitry 406 has a circular shape with a similar, if not the same, diameter (e.g., similar to the electronic device 100 shown in FIG. 2). The similarly shaped and sized layers of the stacked configuration also maximizes an overlap between the transparent conductor of the antenna 402 and the display 404, which can improve the overall transparency of the antenna 402 relative to the display 404, particularly at the outer edges of the antenna 402, as described herein. Increasing an overall size of the transparent conductor can also improve the radiated performance of the antenna 402. Moreover, removing the antenna 402 from inside the housing 410 can create more space within the housing 410 for the wireless communication circuitry 406 and other electronics, thus creating the potential for adding more features to the electronic device 400. The stacked configuration of the electronic device 400 may also create enough space between the antenna 402 and a bottom surface of the housing 410 to minimize any antenna detuning due to placing the electronic device 400 on or adjacent to the user's body (e.g., on the user's wrist or arm).

In some embodiments, the antenna 402 can be configured to have a slot antenna structure or topology that is formed between the transparent conductor and at least a portion of the housing 410. In other embodiments, the antenna 402 can be configured as any other suitable type of antenna (e.g., IFA, PIFA, loop, ILA, DILA etc.). Further, while FIG. 4 shows the antenna 402 as comprising one antenna structure formed from the transparent conductor, in other embodiments, the antenna 402 may be formed from a plurality of transparent conductors, each piece of transparent conductor forming a separate antenna structure.

Referring back to FIG. 1, in embodiments, the wristband 104 can be comprised of conductive materials, non-conductive materials, or a combination thereof. In some cases, the wristband 104 can be interchanged with another wristband (not shown) that comprises conductive and/or non-conductive materials. In embodiments where the wristband 104 may comprise a conductive material, the electronic device 100 can be configured to electromagnetically isolate the wristband 104 from the transparent conductor included in the antenna 108 and thereby, prevent unwanted coupling between the conductive wristband 104 and the antenna 108.

For example, in some embodiments, to help isolate the conductive wristband 104 from the antenna 108, the electronic device 100 may include the component stack 408 shown in FIG. 1 or another similar stacked configuration for arranging the antenna 108 above the display 106 and other components of the electronic device 100. For example, this stacked configuration may naturally increase a distance between the transparent conductor and the wristband 104, and thereby prevent coupling therebetween. In some cases, a vertical distance between the antenna 108 and an attachment point of the wristband 104 to either side of the housing 110 can be selected to provide adequate radio frequency isolation for the antenna 108.

As another example, in some embodiments, the antenna topology of the transparent conductor can help isolate the antenna 108 from the conductive wristband 104, especially at high frequency or operating bands (e.g., greater than 1 GHz). For example, certain intrinsic characteristics of slot or loop antenna topologies may naturally confine the electric and magnetic fields generated by die antenna 108 within an antenna keepout volume of the antenna 108 and therefore, away from the connection between the wristband 104 and the housing 110. Thus, in some cases, the antenna topology of the transparent conductor may be selected to maximize radio frequency isolation of the antenna 108.

Figure 5:
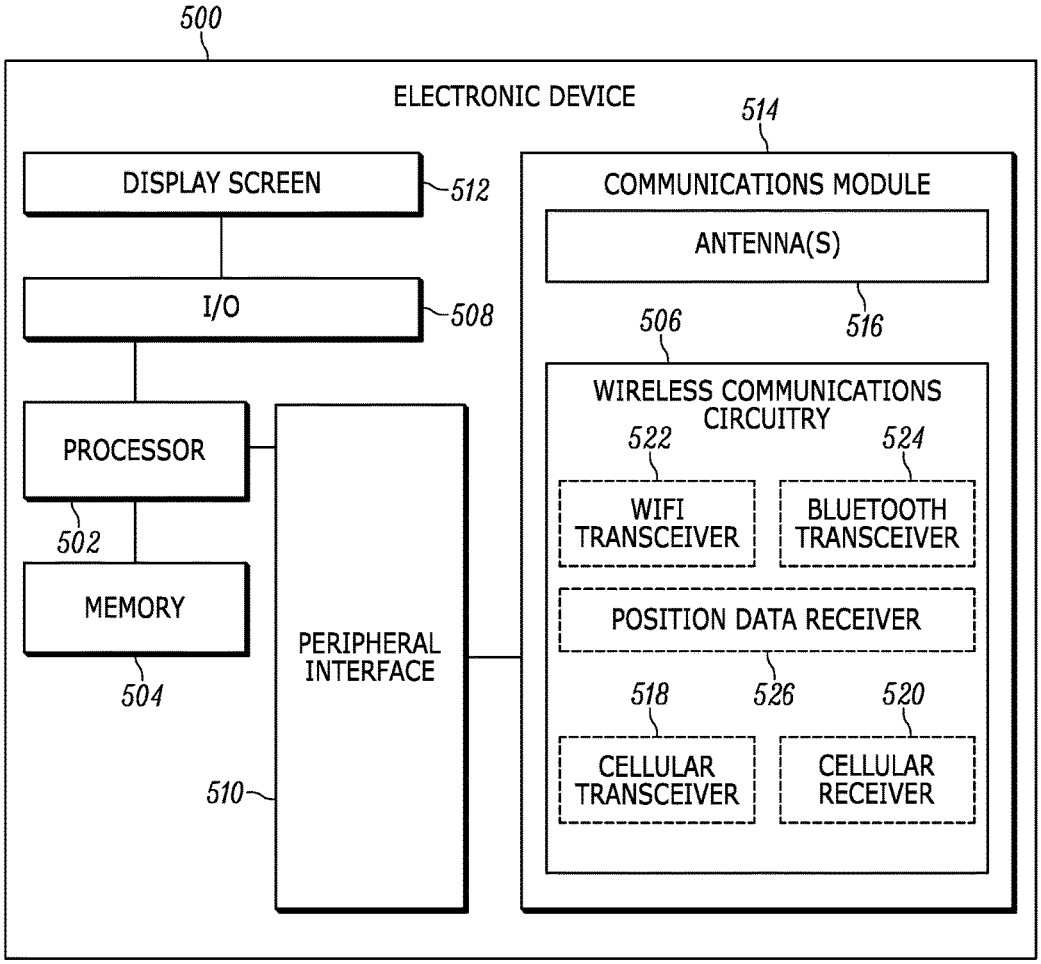
FIG. 5 is a block diagram of an example electronic device in accordance with certain embodiments.

FIG. 5 illustrates an example electronic device 500 in accordance with certain embodiments. The electronic device 500 may be implemented as the electronic device 100 shown in FIG. 1, the electronic device 300 shown in FIG. 3, and/or the electronic device 400 shown in FIG. 4. The electronic device 500 can be configured to support a variety of functionalities and applications. For example, the electronic device 500 may support wireless communication functionalities such as telephone calls, text messaging, video calls, Internet browsing, emailing, and/or the like, using piezo elements positioned and configured to act as microphones and speakers for supporting telephony and other voice functions. Further, for example, the electronic device 500 may support applications such as games, utilities (e.g., calculators, camera applications, etc.), configuration applications, and/or the like. The electronic device 500 may also support voice-activation technology that allows users to initiate and operate functions and applications of the device 500. In some embodiments, the electronic device 500 may be configured to connect to various wired or wireless personal, local, or wide area networks to facilitate communication with network components and/or other devices.

To achieve these and other functionalities, the electronic device 500 can include a processor 502 (e.g., data processor, microprocessor, microcontroller, and others), a memory 504 (e.g., electronic memory, hard drive, flash memory, MicroSD card, and others), an input/output (I/O) controller 508, a peripheral interface 510, a communications module 514 coupled to the peripheral interface 510, and a display screen 512 (such as, e.g., display screen 106 shown in FIG. 1) coupled to the I/O controller 508. The processor 502 can be coupled to the memory 504 for retrieving data and/or executed software stored therein. As will be appreciated, though not shown, the electronic device 500 may include additional components for facilitating operation of the device 500, such as, for example, additional I/O components (e.g., one or more speakers, microphones, cameras, sensors, etc.) coupled to the I/O controller 508, one or more external ports (e.g., USB port, etc.) coupled to the peripheral interface 510, and/or a power module (e.g., one or more batteries, charging circuits, etc.) for providing power to the components of the electronic device 500.

The display screen 512 can display information and/or images received from the processor 502 via the I/O controller 508. In embodiments, the display screen 512 may be configured to form portions of a user interface (e.g., portions of the electronic device 500 associated with presenting information to the user and/or receiving inputs from the user). In such cases, the display screen 512 may also provide user-entered information or inputs to the processor 502 via the I/O controller 508. For example, the display screen 512 may be a touchscreen display comprising a thin, transparent touch sensor component superimposed upon a display section (e.g., a capacitive display, resistive display, surface acoustic wave (SAW) display, optical imaging display, or the like).

As shown in FIG. 5, the communications module 514 can include one or more antennas 516 (such as, e.g., antenna 108 shown in FIG. 1) for wirelessly receiving and transmitting voice and/or data signals and wireless communication circuitry 506 for supporting these antenna functions, in accordance with IEEE (e.g., Wi-Fi), 3GPP, or other standards. The communications module 514 can interface with the peripheral interface 510 to transmit signals received via the antenna(s) 516 to the processor 502 and to receive signals from the processor 502 for transmission to remote devices and/or servers via the antenna(s) 516. The number of antennas included in the communications module 514 may depend on the type(s) of the wireless technologies supported by the communications module 514 and/or the wireless communication circuitry 506. In some embodiments, the one or more antenna(s) 516 includes a single, multi-band antenna tuned to operate across a broad range of frequency bands (also referred to as "operating bands") in order to support several different wireless technologies (e.g., cellular and/or non-cellular communications). For example, the antenna 516 may be configured to operate in at least one of the frequency bands at a time, thus allowing the antenna 516 to be small in size, but broad in function. In other embodiments, the one or more antenna(s) 516 includes multiple antennas (e.g., an antenna farm), each antenna tuned to one or more frequency bands that are associated with a specific wireless technology.

Though not shown, the wireless communication circuitry 506 may include, for example, a plurality amplifiers, power inverters, filters, switches, matching networks (e.g., including one or more resisters, inductors, and/or capacitors), and other components typically found in the radio frequency (RF) front-end architecture of a mobile communications device. In addition, the wireless communication circuitry 506 can include one or more WWAN transceivers, such as, cellular transceiver 518 shown in FIG. 5, for communicating with a wide area network, such as an LTE network, that includes one or more cell sites or base stations to communicatively connect the electronic device 500 to remote devices or servers. The wireless communications circuitry 506 can also include one or more diversity or MIMO (multiple-input, multiple-output) receivers, such as, e.g., cellular receiver 520 shown in FIG. 5, for receiving additional communications from the same wide area network as the cellular transceiver 518. For example, the cellular transceiver 518 may support a main LTE antenna function of the antenna(s) 516, while the cellular receiver 520 may be support a MIMO antenna function of the antenna (s)) 516. Further, the wireless communications circuitry 506 can include one or more WLAN transceivers, such as, e.g., WiFi transceiver 522 shown in FIG. 5, for connecting the electronic device 500 to local area networks, such as a Wi-Fi network. In addition, the wireless communications circuitry 506 can include one or more WPAN transceivers, such as, e.g., Bluetooth transceiver 524 shown in FIG. 5, for connecting the electronic device 500 to personal area networks, such as a Bluetooth® network. As shown in FIG. 5, the wireless communications circuitry 506 can also include a position data receiver 526 for obtaining position-related data, or GPS coordinates, from a position data network, such the GPS system. Still further, the wireless communication circuitry 506 can include one or more point-to-point transceivers (not shown) for connecting the electronic device 500 to short-range communication networks, such as, e.g., near-field-communication (NFC) and/or radio frequency identification (RFID).

Thus, it should be clear from the preceding disclosure that the electronic devices described herein provide improved antenna performance by forming one or more antennas from a transparent conductor material and placing the transparent antenna on top of the display lens of the electronic device, while stacking the circuitry of the electronic device below the display lens. When the techniques described herein are implemented in a small form factor device, placing the antenna on top of the display increases the amount of surface area available for the antenna, thus creating enough room for both a main LTE antenna, a MIMO antenna, and several other non-cellular antennas (e.g., Wi-Fi Bluetooth, and GPS). When the techniques disclosed herein are implemented in an electronic watch device or smartwatch, they allow the antenna and other electronics to be removed from the watch band and placed only in the watch housing, thus returning the watchband to being an interchangeable or replaceable component of the watch. Also in smartwatches, placing the antenna on the very top surface of the display naturally directs the antenna upwards and away from the housing of the electronic device, which provides optimal directivity for the GPS antenna and decreases antenna detuning by moving the antenna away from the user's body. When implemented in other types of electronic devices, such as, e.g., a mobile device or smartphone, the techniques described herein enable the display of the electronic device to be made bigger by removing dead areas on the top surface of the display and enable the overall form factor of the device to be reduced by removing the antennas from inside the device housing.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. An electronic device, comprising:

a display unit operable to electronically display information;

an antenna formed from at least one transparent conductor extending across a top surface of the display unit, the antenna configured to provide coverage of a plurality of operating bands including at least one operating band for enabling communication with a cellular network and at least one operating band for enabling communication with a non-cellular network;

a circuitry component positioned under the display unit and comprising wireless communication circuitry operatively coupled to the antenna, wherein the circuitry component is sized and shaped to match a size and shape of the display unit and an outer edge of the at least one transparent conductor is substantially aligned with an outer edge of the display unit, such that the circuitry component, the display unit, and the at least one transparent conductor form a stacked configuration; and a housing encasing the circuitry component, wherein the antenna has a slot antenna structure formed between the at least one transparent conductor and at least a portion of the housing.

2. The electronic device of claim 1, wherein the at least one transparent conductor is a coating placed on top of the top surface of the display unit.

3. The electronic device of claim 1, wherein the at least one transparent conductor is embedded into the top surface of the display unit.

4. The electronic device of claim 1, wherein the at least one transparent conductor extends across at least a substantial portion of the top surface of the display unit.

5. The electronic device of claim 4, wherein the at least one transparent conductor forms a single, continuous antenna structure that extends across the entire top surface of the display unit, the single antenna structure being configured for multi-band operation.

6. The electronic device of claim 1, wherein the housing further encases at least a portion of the display unit.

7. The electronic device of claim 1, wherein the at least one transparent conductor, the display unit, and the circuitry component are stacked in parallel to each other and the housing.

8. An electronic device, comprising:

a display unit operable to electronically display information;

an antenna formed from at least one transparent conductor extending across a top surface of the display unit, the antenna configured to provide coverage of a plurality of operating bands including at least one operating band for enabling communication with a cellular network and at least one operating band for enabling communication with a non-cellular network; and a circuitry component positioned under the display unit and comprising wireless communication circuitry operatively coupled to the antenna, wherein the circuitry component is sized and shaped to match a size and shape of the display unit and an outer edge of the at least one transparent conductor is substantially aligned with an outer edge of the display unit, such that the circuitry component, the display unit, and the at least one transparent conductor form a stacked configuration, and wherein the at least one transparent conductor forms a plurality of antenna structures arranged adjacent to each other and across at least a substantial portion of the top surface of the display unit, the antenna structures configured to support coverage of different operating bands.

9. The electronic device of claim 8, wherein the plurality of antenna structures includes a main cellular antenna, a diversity antenna, and at least one non-cellular antenna.

10. An electronic watch, comprising:

a watch face operable to electronically display information;

an antenna formed from at least one transparent conductor extending across a top surface of the watch face, the antenna configured to provide coverage of a plurality of operating bands including at least one operating band for enabling communication with a cellular network and at least one operating band for enabling communication with a non-cellular network; and a watch housing configured to house a circuitry component positioned under the watch face, the circuitry component comprising wireless communication circuitry operatively coupled to the antenna, wherein the circuitry component is sized and shaped to match a size and shape of the watch face and an outer edge of the at least one transparent conductor is substantially aligned with an outer edge of the watch face, such that the circuitry component, the watch face, and the at least one transparent conductor form a stacked configuration, and wherein the antenna has a slot antenna structure formed between the at least one transparent conductor and at least a portion of the watch housing.

11. The electronic watch of claim 10, wherein the at least one transparent conductor is a coating applied to the top surface of the watch face.

12. The electronic watch of claim 10, wherein the at least one transparent conductor extends across at least a substantial portion of the watch face.

13. The electronic watch of claim 12, wherein the at least one transparent conductor forms a single, continuous antenna structure that extends across the entire top surface of the watch face, the single antenna structure being configured for multi-band operation.

14. The electronic watch of claim 10, wherein the at least one transparent conductor, the watch face, and the circuitry component are stacked in parallel to each other and the watch housing.

15. The electronic watch of claim 10, further comprising a wristband removeably coupled to the watch housing.

16. The electronic watch of claim 15, wherein the wristband comprises a conductive material and a vertical distance between the wristband and the at least one transparent conductor is selected so that the wristband is electromagnetically isolated from the at least one transparent conductor.

17. The electronic device of claim 10, wherein the watch housing is further configured to house at least a portion of the watch face.

18. An electronic watch, comprising:

a watch face operable to electronically display information;

an antenna formed from at least one transparent conductor extending across a top surface of the watch face, the antenna configured to provide coverage of a plurality of operating bands including at least one operating band for enabling communication with a cellular network and at least one operating band for enabling communication with a non-cellular network; and a circuitry component positioned under the watch face and comprising wireless communication circuitry operatively coupled to the antenna, wherein the circuitry component is sized and shaped to match a size and shape of the watch face and an outer edge of the at least one transparent conductor is substantially equal to an outer edge of the watch face, such that the circuitry component, the watch face, and the at least one transparent conductor form a stacked configuration, wherein the at least one transparent conductor forms a plurality of antenna structures arranged adjacent to each other and across at least a substantial portion of the watch face, the antenna structures configured to support coverage of different operating bands.

19. The electronic watch of claim 18, wherein the plurality of antenna structures includes a main cellular antenna, a diversity antenna, and at least one non-cellular antenna.

* * * * *